US011073111B2

(12) United States Patent
MacLennan

(10) Patent No.: US 11,073,111 B2
(45) Date of Patent: Jul. 27, 2021

(54) FUEL VAPOR PRESSURE DETECTION BY BI-DIRECTIONAL PUMP

(71) Applicants: DENSO International America, Inc., Southfield, MI (US); DENSO CORPORATION, Kariya (JP)

(72) Inventor: Brandon MacLennan, Farmington, MI (US)

(73) Assignees: DENSO International America, Inc., Southfield, MI (US); DENSO CORPORATION, Kariya (JP)

( * ) Notice: Subject to any disclaimer, the term of this patent is extended or adjusted under 35 U.S.C. 154(b) by 262 days.

(21) Appl. No.: 16/441,260

(22) Filed: Jun. 14, 2019

(65) Prior Publication Data

US 2020/0063697 A1 Feb. 27, 2020

Related U.S. Application Data

(60) Provisional application No. 62/722,503, filed on Aug. 24, 2018.

(51) Int. Cl.

| | |
|---|---|
| ***F02M 25/08*** | (2006.01) |
| ***F02D 41/22*** | (2006.01) |
| ***F02M 59/20*** | (2006.01) |

(52) U.S. Cl.

CPC ..... *F02M 25/0809* (2013.01); *F02D 41/22* (2013.01); *F02M 59/20* (2013.01); *F02D 2041/225* (2013.01)

(58) Field of Classification Search

CPC .... F02M 25/0809; F02M 59/20; F02D 41/22; F02D 2041/225; F02D 2041/224

See application file for complete search history.

(56) References Cited

U.S. PATENT DOCUMENTS

| | | | | |
|---|---|---|---|---|
| 5,878,727 | A | 3/1999 | Huls | |
| 5,884,610 | A | 3/1999 | Reddy | |
| 6,499,476 | B1 | 12/2002 | Reddy | |
| 7,448,367 | B1 | 11/2008 | Reddy et al. | |
| 9,458,801 | B2 | 10/2016 | Dudar et al. | |
| 9,822,737 | B2 | 11/2017 | Dudar et al. | |
| 9,850,853 | B2 | 12/2017 | Dudar et al. | |
| 10,094,305 | B1 * | 10/2018 | Klein | F02D 41/3854 |
| 2005/0211228 | A1 * | 9/2005 | Amano | F02M 25/0827 123/520 |
| 2014/0297071 | A1 * | 10/2014 | Dudar | F02D 41/22 701/22 |
| 2015/0114089 | A1 * | 4/2015 | Dudar | F02M 25/0809 73/40 |
| 2015/0285171 | A1 * | 10/2015 | Dudar | F02M 25/0809 73/114.39 |
| 2018/0245545 | A1 * | 8/2018 | Benjey | F02D 41/004 |
| 2020/0063697 | A1 * | 2/2020 | MacLennan | F02M 25/0809 |

FOREIGN PATENT DOCUMENTS

KR 101632891 B1 6/2016

* cited by examiner

*Primary Examiner* — George C Jin

(74) *Attorney, Agent, or Firm* — Harness, Dickey & Pierce, P.L.C.

(57) ABSTRACT

Systems and method for determining a Reid vapor pressure of a fuel system using a bi-directional pump of the fuel system. The determined Reid vapor pressure is compared to reference Reid vapor pressures to identify the presence of, and size of, a leak in the fuel system.

20 Claims, 4 Drawing Sheets

| Fuel Level / Leak Size | No Leak | 0.10" Leak | 0.020" Leak | 0.030" Leak |
|---|---|---|---|---|
| 20% | 0.05 kPa /sec | 0.1 kPa /sec | 0.2 kPa /sec | 0.4 kPa /sec |
| 40% | 0.1 kPa /sec | 0.2 kPa /sec | 0.4 kPa /sec | 0.6 kPa /sec |
| 60% | 0.2 kPa /sec | 0.4 kPa /sec | 0.6 kPa /sec | 0.8 kPa /sec |
| 80% | 0.4 kPa /sec | 0.6 kPa /sec | 0.8 kPa /sec | 1.0 kPa /sec |

FUEL VAPOR PRESSURE DETECTION BY BI-DIRECTIONAL PUMP

CROSS-REFERENCE TO RELATED APPLICATION

This application claims the benefit of U.S. Provisional Application No. 62/722,503, filed on Aug. 24, 2018, the entire disclosure of which is incorporated herein by reference.

FIELD

The present disclosure relates to determining Reid vapor pressure of a fuel system with a bi-directional pump to detect leaks in the fuel system.

BACKGROUND

This section provides background information related to the present disclosure, which is not necessarily prior art.

Vehicle manufacturers and suppliers are continuously looking for cost effective methods and systems for detecting fuel system leaks. While current methods and systems are suitable for their intended use, they are subject to improvement. The present disclosure advantageously provides for improved methods and systems for detecting fuel system leaks that are more robust compared to current systems and methods for increasingly difficult standards.

SUMMARY

This section provides a general summary of the disclosure and is not a comprehensive disclosure of its full scope or all of its features.

The present disclosure includes a method for determining a Reid vapor pressure of a fuel system using a bi-directional pump located in the fuel system. The method includes: activating the bi-directional pump in a first direction until fuel pressure of the fuel system changes from a base level to a first predetermined fuel pressure, and deactivating the bi-directional pump when the fuel pressure reaches the first predetermined fuel pressure; recording a first rate of fuel pressure decay of the fuel pressure as the fuel pressure changes from the first predetermined fuel pressure to the base level; after the fuel pressure of the fuel system has returned to the base level, or after a predetermined period of time has expired, activating the bi-directional pump in a second direction opposite to the first direction until fuel pressure of the fuel system changes from the base level to a second predetermined fuel pressure, and again deactivating the bi-directional pump when the fuel pressure reaches the second predetermined fuel pressure; recording a second rate of fuel pressure decay of the fuel pressure as the fuel pressure changes from the second predetermined fuel pressure to the base level; and determining the Reid vapor pressure to be calculated by a difference between the first rate of fuel pressure decay and the second rate of fuel pressure decay.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of select embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
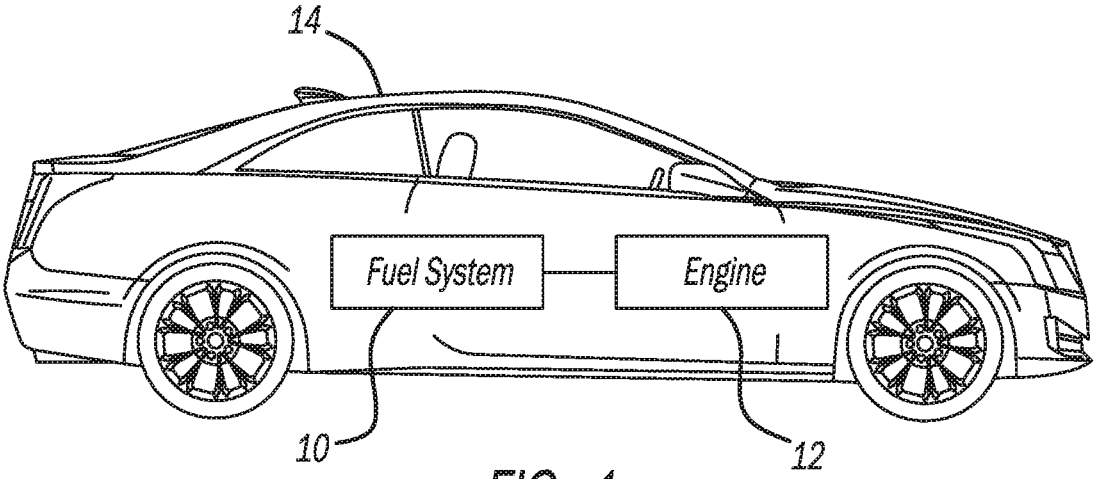
FIG. 1 illustrates a vehicle including a fuel system in accordance with the present disclosure.

FIG. 1 illustrates a fuel system 10 in accordance with the present disclosure. In the example illustrated, the fuel system 10 is configured to deliver fuel to an engine 12 of a vehicle 14. In addition to providing fuel to the vehicle engine 12, the fuel system 10 can be configured to deliver fuel to any other suitable engine as well. With respect to vehicles, the engine 12 can be configured for propelling any suitable passenger vehicle, mass transit vehicle, recreational vehicle, military vehicle/equipment, construction vehicle/equipment, motorcycle, watercraft, etc. The fuel system 10 may also be configured to deliver fuel to any suitable non-vehicular engines, such as a generator engine, etc.

Figure 2:
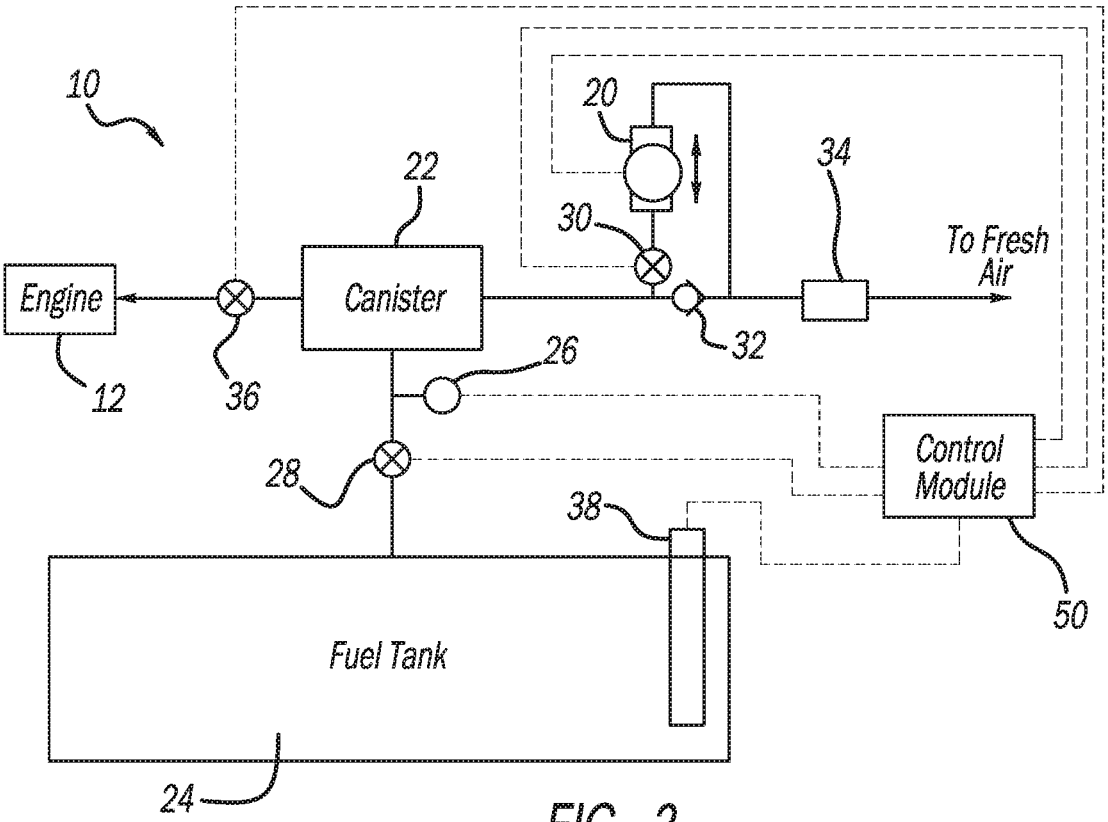
FIG. 2 illustrates a bi-directional pump and other components of the fuel system of FIG. 1.

With additional reference to FIG. 2, the fuel system 10 includes a pump 20, which is a bi-directional pump configured to generate both a positive pressure and a negative pressure in the fuel system 10. Also included in the fuel system 10 is an evaporative emissions control canister 22, which is connected to a fuel tank 24 by a fuel tank vent line. The canister 22 includes activated charcoal that acts like a sponge by absorbing and storing fuel vapors until a purge valve 36 is opened and allows the vacuum of the engine intake to siphon the fuel vapors from the charcoal into the engine intake manifold. A fuel tank isolation valve 28 is arranged along a fuel line between the fuel tank 24 and the canister 22. Along the line between the fuel tank isolation valve 28 and the canister 22 is a pressure sensor 26. The pressure sensor 26 is any suitable sensor configured to measure fuel pressure. A canister vent solenoid valve 30 is arranged along a line between the bi-directional pump 20 and the canister 22. A check valve 32 is included to restrict fuel flow back towards the canister 22. Proximate to a fresh air outlet of the fuel system 10 is a dust filter 34 configured to filter dust and other similar particulates.

The fuel system 10 further includes a control module 50. The control module 50 is configured to control at least the bi-directional pump 20, the canister vent solenoid valve 30, the canister purge valve 36, and the fuel tank isolation valve 28. The control module 50 further receives inputs from the pressure sensor 26 identifying the fuel pressure of the fuel system 10. In this application, including the definitions below, the term "control module" may be replaced with the term "circuit." The term "control module" may refer to, be part of, or include processor hardware (shared, dedicated, or group) that executes code and memory hardware (shared, dedicated, or group) that stores code executed by the processor hardware. The code is configured to provide the features of the modules, controllers, and systems described herein. The term memory hardware is a subset of the term computer-readable medium. The term computer-readable medium, as used herein, does not encompass transitory electrical or electromagnetic signals propagating through a medium (such as on a carrier wave); the term computer-readable medium is therefore considered tangible and non-transitory. Non-limiting examples of a non-transitory computer-readable medium are nonvolatile memory devices (such as a flash memory device, an erasable programmable read-only memory device, or a mask read-only memory device), volatile memory devices (such as a static random access memory device or a dynamic random access memory device), magnetic storage media (such as an analog or digital magnetic tape or a hard disk drive), and optical storage media (such as a CD, a DVD, or a Blu-ray Disc).

Figure 3:
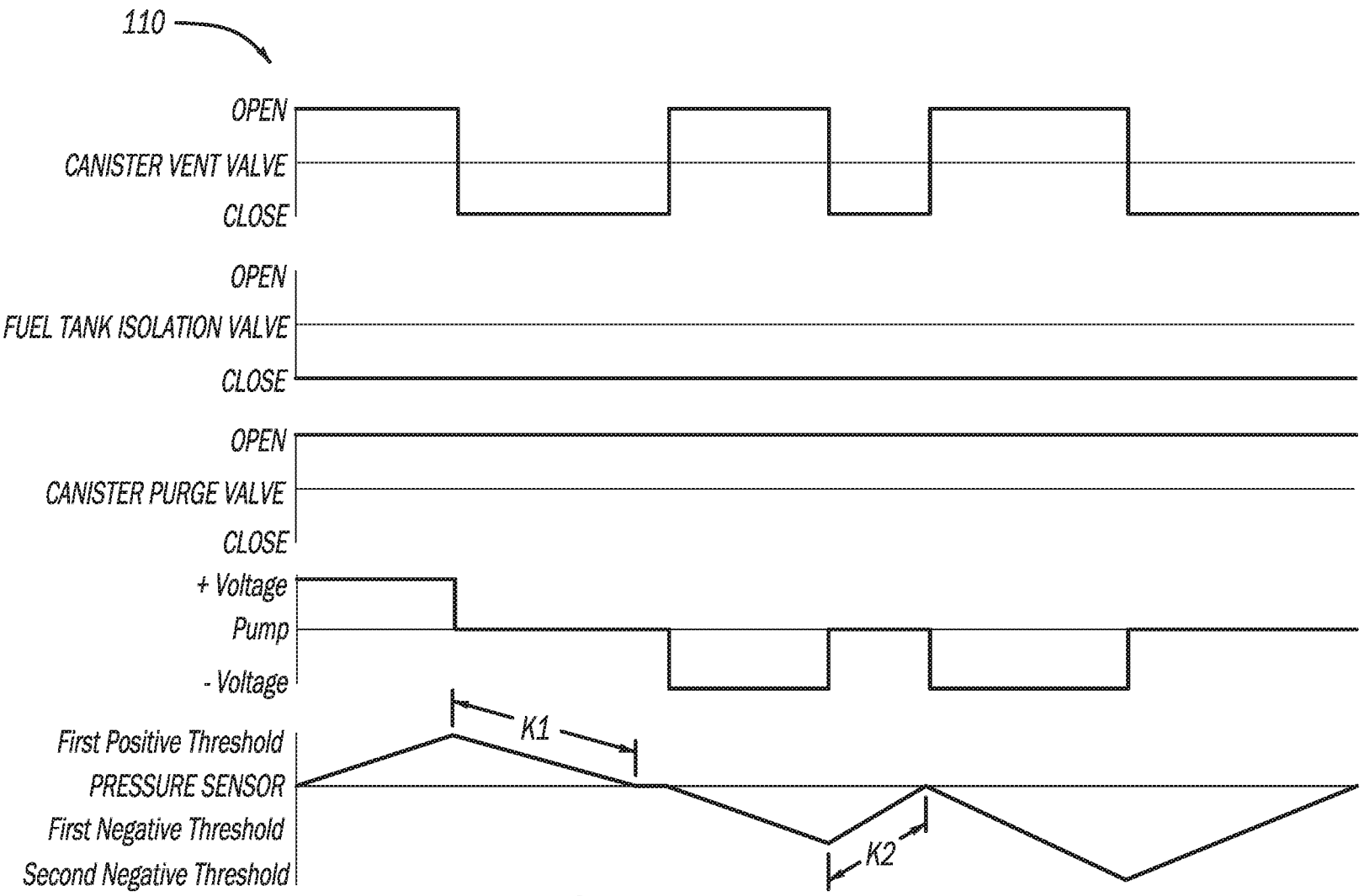
FIG. 3 illustrates operation of the following possible components of the fuel system of FIG. 2 in accordance with the present disclosure: a canister vent valve; a fuel tank valve; a canister purge valve; the bi-directional pump; and a pressure sensor.
Figure 4:
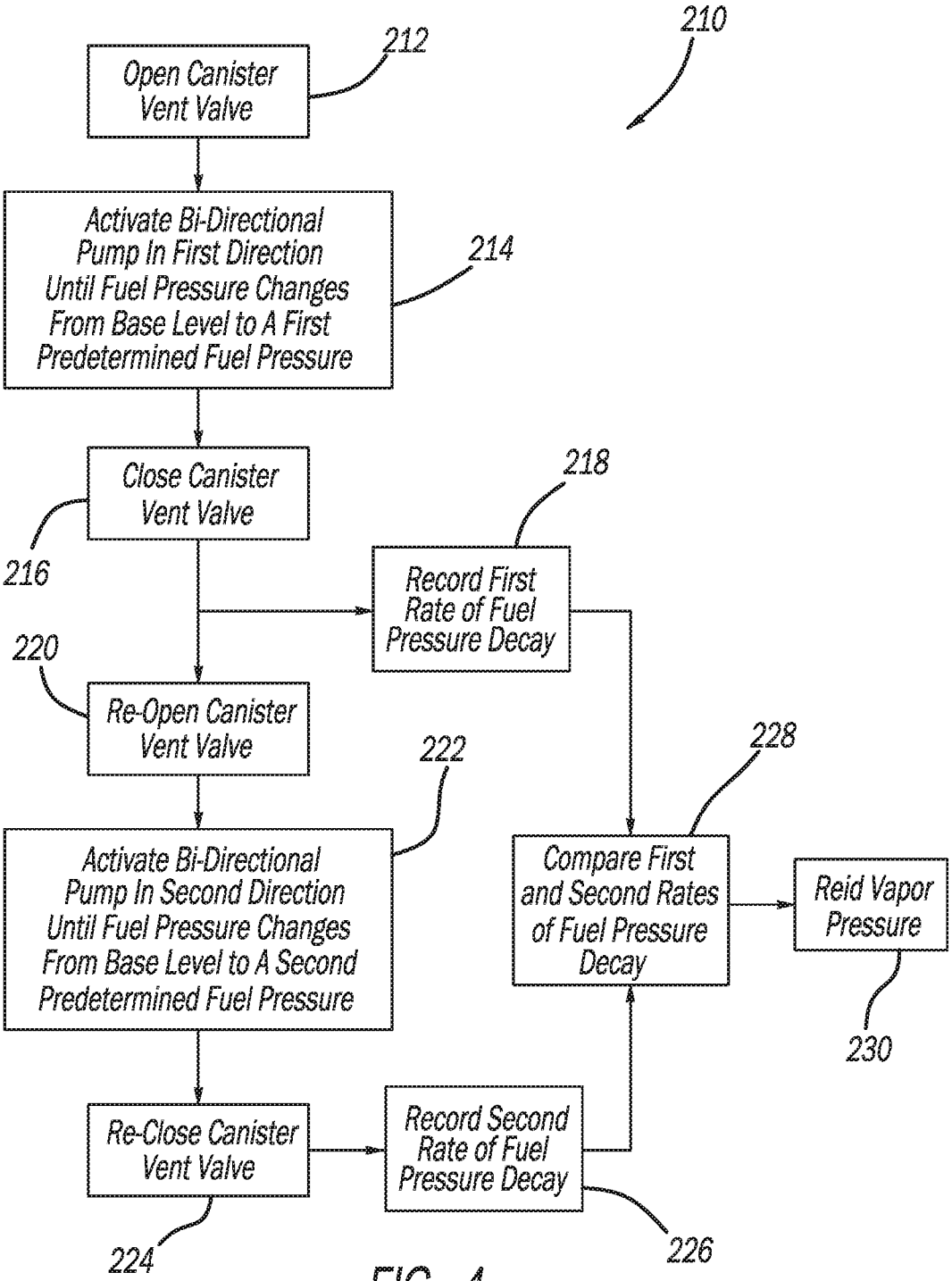
FIG. 4 illustrates a method in accordance with the present disclosure for determining Reid vapor pressure using the bi-directional pump.

With reference to FIG. 3, the graphs at reference numeral 110 illustrate operation of the canister vent valve 30 (which may be any suitable valve such as a solenoid valve), the fuel tank isolation valve 28, the canister purge valve 36, and the bi-directional pump 20. Also illustrated are exemplary fuel pressure readings of the pressure sensor 26. As explained herein, throughout the exemplary method 210 the fuel tank isolation valve 28 remains closed and the canister purge valve 36 remains open. FIG. 4 illustrates the exemplary method 210 for using the fuel system 10 to arrive at a Reid vapor pressure 230. Although the method 210 will be described as performed by the fuel system 10, the method 210 may be performed by any other suitable fuel system as well.

With initial reference to block 212 of the method 210, the control module 50 opens the canister vent valve 30. At block 214, the control module 50 activates the bi-directional pump 20 in a first direction (such as to create positive pressure as illustrated in FIG. 3) until the fuel pressure changes from a base level to a first predetermined fuel pressure. In the example of FIG. 3, the first predetermined fuel pressure is any suitable first positive or negative threshold. Once the fuel pressure reaches the first predetermined fuel pressure, the control module 50 closes the canister vent valve 30 at block 216. Once the canister vent valve 30 is closed, the fuel pressure will begin to return to the base level from the first predetermined fuel pressure, as indicated at the example of K1 of FIG. 3. At block 218, this first rate of fuel pressure decay K1 is recorded by the control module 50.

After the fuel pressure has returned to the base level (or after a predetermined time interval, for example), the control module 50 reopens the canister vent valve 30 at block 220. Also, the control module 50 activates the bi-directional pump 20 in a second direction (such as to create a vacuum as illustrated in the example of FIG. 3) until the fuel pressure changes from the base level to a second predetermined fuel pressure (see block 222). In the example of FIG. 3, the second predetermined fuel pressure is any suitable second positive or negative threshold. Once the fuel pressure reaches the second predetermined fuel pressure, the method 210 proceeds to block 224. At block 224 the control module 50 again closes the canister vent valve 30. Once the canister vent valve 30 is closed, the fuel pressure gradually returns to the base level from the second predetermined fuel pressure. In the example of FIG. 3, this return of the fuel pressure to the base level is represented by the slope K2. This second rate of fuel pressure decay K2 is recorded by the control module 50 at block 226.

From blocks 218 and 226 the method 210 proceeds to block 228. At block 228, the control module 50 compares the first rate (slope K1) and second rate (slope K2) of fuel pressure decay. The difference between the first and second rates K1 and K2 can be used by the control module 50 to calculate a current Reid vapor pressure (see block 230), as explained below.

K2-K1 is the decay rate difference in the vacuum pressure check and the positive pressure check (i.e. the pressure rise resultant from vapor generation). The first step in solving K2-K1 is to solve for the air/fuel volume evacuated during the K2 check. This includes determining how much vapor was evacuated from the fuel tank 24 during the vacuum pressure check of block 214 or block 222. The contents of the tank 24 are assumed to be perfectly mixed (fuel vapor and air particles). The volume of air/fuel evacuated is calculated based on the K2 pressure set point (a factor that may be arrived at subsequent to a series of trials) and the vapor space volume of the tank 24 (total fuel space volume—current amount of fuel in the vehicle). P1V1=P2V2 is used to calculate the volume of air+fuel evacuated from the fuel tank 24, where: P1=atmospheric; P2=atmospheric—K2; V1=vapor volume; and V2=solved parameter). The vapor pressure generated while the fuel tank 24 is in vacuum during the K check is assumed to be 0 because the check will be very short in time for a low K2 pressure set point and high flowing pump. The volume from the tank (V1-V2) evacuated is thus known.

In the second step, the fuel vapor portion of the evacuated volume (V1-V2) calculated above is estimated by using an estimated RVP value and the measured fuel temperature. The estimated RVP value can be obtained from a previous leak check RVP calculation, or in any other suitable manner. RVP and temperature are used to obtain the vapor pressure of the fuel vapor using the Antoine Equation. The rule of partial pressures is then used to calculate the percent air/fuel mixture and the corresponding portion of the evacuated volume that belonged to the fuel vapor.

In the third step, the vacuum decay measured in K2 is then predicted using the estimated initial fuel vapor amount in the tank (fuel vapor concentration×V) from step 2 and the new fuel vapor amount (fuel concentration×V2) also calculated in step 2. These parameters are paired with a time that K2 was measured across (determined by the engineer). All of these parameters are included in the following Fick's second law of diffusion calculation:

$$\frac{\partial C_f(z,t)}{\partial t} = D\frac{\partial^2 C_f(z,t)}{\partial z^2}$$

Boundary conditions are set with the initial vapor concentration (Ci=XX %) and the new vapor concentration (Cf=XX %), where Cf is higher than Ci due to vapor generation. Ci=Initial vapor volume/V1, and Cf=Initial vapor volume +V1-V2/V1. D is a known mass diffusivity coefficient of the fuel. The equation is integrated to determine the rate of vapor evaporation and thus the pressure generation rate K2*e*. K2*e* is the estimated K2 based on the estimated RVP from Step 2.

In the fourth and final step, the measured K2 is compared to the estimated K2*e*. If the values are within a predetermined range of one another, then the estimated RVP is taken to be the real fuel RVP and the solution is found. If the K2 and K2*e* values are not within the predetermined range (and thus too far apart), RVP is re-estimated based on the difference (i.e. if K2*e* is greater than K2 then the RVP estimate is lowered by a pre-determined amount) and the process returns to step 2. This process is repeated until an acceptable comparison is made.

Figures 5, 6:
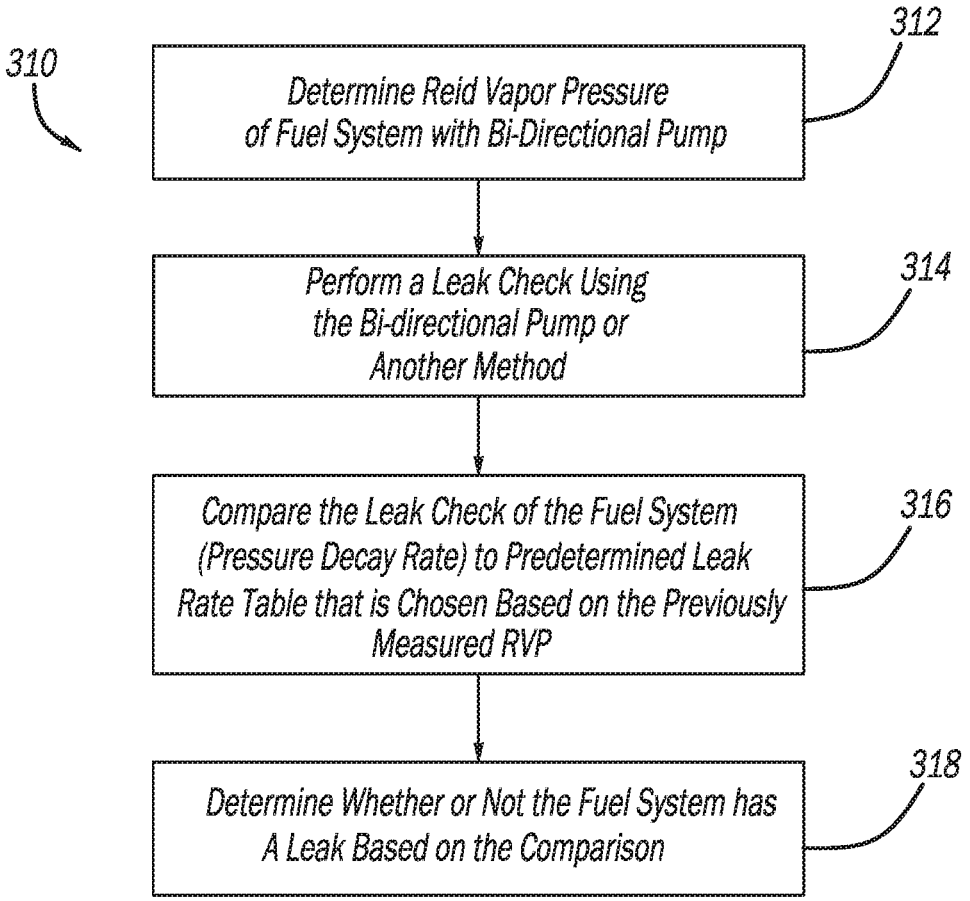
FIG. 5 illustrates a method in accordance with the present disclosure for using the determined Reid vapor pressure to determine whether the fuel system has a leak.
FIG. 6 illustrates various exemplary leak and no leak conditions for reference fuel pressure decay rates at different fuel levels.

Depending on the solved RVP value, different leak check tables can be used, such as the table of FIG. 6. A new table can be created for different RVP values (example: one table every half point of RVP: 5, 5.5, 6, 6.5, . . . , 14), and then the real leak judgement can be solved based on the correct look up table or an interpolation between them.

With additional reference to FIG. 5, a method 310 for determining whether the fuel system 10 has a fuel leak is illustrated. At block 312, the Reid vapor pressure of the fuel system 10 with the bi-directional pump 20 is determined, such as by the method 210. From block 312, the method proceeds to block 314. At block 314, the control module 50 performs a leak check using the bi-directional pump 20, or any other suitable method. From block 314, the method 310 proceeds to block 316. At block 316, the control module 50 compares the leak check of the fuel system 10 (pressure decay rate) to a predetermined leak rate table chosen based on the previously measured Reid vapor pressure. If the determined Reid vapor pressure (determined at block 312) is equal to (or about equal to) a reference Reid vapor pressure corresponding to a fuel leak condition of the fuel system 10, then at block 318 the control module 50 will determine that the fuel system 10 has a fuel leak and generate an appropriate alert notification. If at block 316 the determined Reid vapor pressure is equal to, or about equal to, a reference Reid vapor pressure value corresponding to a no leak condition of the fuel system 10, then at block 318 the control module 50 will determine that the fuel system 10 does not have a fuel leak.

With reference to FIG. 6, the method 210 may be used to determine the Reid vapor pressure of the fuel system 10 a plurality of times over a predetermined period to arrive at a plurality of Reid vapor pressures corresponding to a measured fuel pressure decay rate. FIG. 6 illustrates a plurality of reference fuel pressure decay rates for various leak conditions of the fuel system 10, such as the following: no leak; 0.10" sized leak; 0.020" sized leak; and 0.030" sized leak. The size of the fuel leak that the reference fuel pressure decay rates correspond to is also dependent upon the fuel level of the fuel tank 24. Thus FIG. 6 illustrates exemplary fuel levels of the fuel tank 24. The reference fuel pressure decay rates must therefore be cross-referenced with the fuel levels. A table, such as the table of FIG. 6, can be generated many times at different known Reid Vapor Pressure levels to characterize the leakage rate of a fuel system.

The measured fuel pressure decay rate (arrived at based on determining the Reid vapor pressure using the method 210 a plurality of times over any suitable predetermined period) is compared to the reference fuel pressure decay rates of FIG. 6 by the control module 50. The fuel level of the fuel tank 24 (determined by the control module 50 based on inputs from fuel level sensor 38) is also compared with the reference fuel levels of FIG. 6. The reference fuel pressure decay rate of FIG. 6 that is closest to the measured fuel pressure decay rate at the fuel level of the fuel tank 24 is identified by the control module 50, and cross-referenced by the control module 50 to the leak condition of FIG. 6 (e.g., no leak, 0.10" sized leak; 0.020" sized leak; or 0.030" sized leak) to determine the size of the leak, if any, in the fuel system 10.

The present disclosure thus advantageously provides for the method 210 for identifying a Reid vapor pressure of the fuel system 10 based on use of the bi-directional pump 20. The determined Reid vapor pressure is then compared to reference Reid vapor pressures by the control module 50 associated with a no-leak condition and various leak conditions of different sizes. Based on th comparison, the control module 50 determines whether or not a leak condition is present in the fuel system 10. The use of the bi-directional pump 20 in accordance with the present disclosure to identify the Reid vapor pressure provides cost advantages and various other efficiencies as one skilled in the art will appreciate. Based on the determined Reid vapor pressure, the control module 50 is configured to modify an air-fuel ratio of the engine 12 to increase fuel economy and overall engine performance. One skilled in the art will appreciate that the present disclosure provides numerous additional advantages and unexpected results in addition to those specifically described herein.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A method for determining a Reid vapor pressure of a fuel system using a bi-directional pump of the fuel system, the method comprising:

activating the bi-directional pump in a first direction until fuel pressure of the fuel system changes from a base level to a first predetermined fuel pressure, and deactivating the bi-directional pump when the fuel pressure reaches the first predetermined fuel pressure;

recording a first rate of fuel pressure decay of the fuel pressure as the fuel pressure changes from the first predetermined fuel pressure to the base level;

after the fuel pressure of the fuel system has returned to the base level or after a predetermined period of time has expired, activating the bi-directional pump in a second direction opposite to the first direction until fuel pressure of the fuel system changes from the base level to a second predetermined fuel pressure, and again deactivating the bi-directional pump when the fuel pressure reaches the second predetermined fuel pressure;

recording a second rate of fuel pressure decay of the fuel pressure as the fuel pressure changes from the second predetermined fuel pressure to the base level; and determining the Reid vapor pressure to be calculated by a difference between the first rate of fuel pressure decay and the second rate of fuel pressure decay.

2. The method of claim 1, wherein:

operating the bi-directional pump in the first direction is operating the bi-directional pump to generate a first pressure; and operating the bi-directional pump in the second direction is operating the bi-directional pump to generate a second pressure that is opposite to the first pressure.

3. The method of claim 1, further comprising comparing the determined Reid vapor pressure with a reference Reid vapor pressure corresponding to a fuel leak condition in the fuel system; and determining that fuel system has a fuel leak when the determined Reid vapor pressure is equal to, or about equal to, the reference Reid vapor pressure.

4. The method of claim 1, further comprising determining the Reid vapor pressure a plurality of times over a predetermined period to arrive at a plurality of Reid vapor pressures corresponding to a measured fuel pressure decay rate;

comparing the measured fuel pressure decay rate to a plurality of reference fuel pressure decay rates each corresponding to a different fuel leak diameter of the fuel system to determine which one of the reference fuel pressure decay rates the measured fuel pressure decay rate corresponds to; and determining that the fuel system has a fuel leak with a diameter corresponding to the fuel leak diameter of the reference fuel pressure decay rate that the measured fuel pressure decay rate corresponds to.

5. A method for determining a Reid vapor pressure of a fuel system using a bi-directional pump of the fuel system, the method comprising:

opening a canister vent valve of the fuel system, and activating the bi-directional pump in a first direction until fuel pressure of the fuel system changes from a base level to a first predetermined fuel pressure;

closing the canister vent valve of the fuel system once the first predetermined fuel pressure is reached, and deactivating the bi-directional pump;

once the canister vent valve is closed and the bi-directional pump is deactivated, recording a first fuel pressure decay slope of the fuel pressure as the fuel pressure changes from the first predetermined fuel pressure to the base level;

after the fuel pressure of the fuel system has returned to the base level, reopening the canister vent valve of the fuel system and activating the bi-directional pump in a second direction opposite to the first direction until fuel pressure of the fuel system changes from the base level to a second predetermined fuel pressure;

reclosing the canister vent valve of the fuel system once the second predetermined fuel pressure is reached, and again deactivating the bi-directional pump;

once the canister vent valve is reclosed and the bi-directional pump is again deactivated, recording a second fuel pressure decay slope of the fuel pressure as the fuel pressure changes from the second predetermined fuel pressure to the base level; and determining the Reid vapor pressure to be calculated by a difference between the first fuel pressure decay slope and the second fuel pressure decay slope.

6. The method of claim 5, wherein:

operating the bi-directional pump in the first direction is operating the bi-directional pump to generate a first pressure; and operating the bi-directional pump in the second direction is operating the bi-directional pump to generate a second pressure that is opposite to the first pressure.

7. The method of claim 5, wherein the canister vent valve is a canister vent solenoid between the bi-directional pump and a canister configured to absorb fuel vapor.

8. The method of claim 5, further comprising comparing the determined Reid vapor pressure with a reference Reid vapor pressure corresponding to a fuel leak condition in the fuel system; and determining that fuel system has a fuel leak when the determined Reid vapor pressure is equal to, or about equal to, the reference Reid vapor pressure.

9. The method of claim 5, further comprising determining the Reid vapor pressure a plurality of times over a predetermined period to arrive at a plurality of Reid vapor pressures corresponding to a measured fuel pressure decay rate;

comparing the fuel pressure decay rate to a plurality of reference fuel pressure decay rates each corresponding to a different fuel leak diameter of the fuel system to determine which one of the reference fuel pressure decay rates the measured fuel pressure decay rate corresponds to; and determining that the fuel system has a fuel leak with a diameter corresponding to the fuel leak diameter of the reference fuel pressure decay rate that the measured fuel pressure decay rate corresponds to.

10. The method of claim 5, further comprising:

determining the Reid vapor pressure a plurality of times over a predetermined period to arrive at a plurality of Reid vapor pressures corresponding to a measured fuel pressure decay rate;

measuring fuel level within a fuel tank of the fuel system over the predetermined period of time with a fuel level sensor;

comparing the fuel pressure decay rate and the measured fuel level to a plurality of reference fuel pressure decay rates and fuel levels each corresponding to a different fuel leak diameter of the fuel system to determine which one of the reference fuel pressure decay rates and fuel levels the measured fuel pressure decay rate and measured fuel level correspond to; and determining that the fuel system has a fuel leak with a diameter corresponding to the fuel leak diameter of the reference fuel pressure decay rate and fuel level that the measured fuel pressure decay rate and measured fuel level correspond to.

11. The method of claim 5, further comprising modifying an air-fuel ratio of an engine in receipt of fuel from the fuel system based on the Reid vapor pressure.

12. The method of claim 5, further comprising determining the Reid vapor pressure with a fuel tank isolation valve of the fuel system closed and a canister purge valve of the fuel system open.

13. A fuel system for delivering fuel to an engine from a fuel tank, the fuel system comprising:

an evaporative emissions control (EVAP) canister;

a bi-directional pump;

a canister vent valve along a fuel line between the bi-directional pump and the EVAP canister;

a pressure sensor configured to measure pressure of the fuel; and a control module configured to:

activate the bi-directional pump in a first direction until fuel pressure of the fuel system changes from a base level to a first predetermined fuel pressure, and deactivating the bi-directional pump when the fuel pressure reaches the first predetermined fuel pressure;

record a first rate of fuel pressure decay of the fuel pressure as the fuel pressure changes from the first predetermined fuel pressure to the base level;

after the fuel pressure of the fuel system has returned to the base level or after expiration of a predetermined period of time, activate the bi-directional pump in a second direction opposite to the first direction until fuel pressure of the fuel system changes from the base level to a second predetermined fuel pressure, and again deactivating the bi-directional pump when the fuel pressure reaches the second predetermined fuel pressure;

record a second rate of fuel pressure decay of the fuel pressure as the fuel pressure changes from the second predetermined fuel pressure to the base level; and determine the Reid vapor pressure to be calculated by a difference between the first rate of fuel pressure decay and the second rate of fuel pressure decay.

14. The fuel system of claim 13, wherein:

activating the bi-directional pump in the first direction includes operating the bi-directional pump to generate positive pressure; and activating the bi-directional pump in the second direction includes operating the bi-directional pump to generate negative pressure.

15. The fuel system of claim 13, wherein the control module is further configured to:

compare the determined Reid vapor pressure with a reference Reid vapor pressure corresponding to a fuel leak condition in the fuel system; and determine that fuel system has a fuel leak when the determined Reid vapor pressure is equal to, or about equal to, the reference Reid vapor pressure.

16. The fuel system of claim 13, wherein the control module is further configured to:

determine the Reid vapor pressure a plurality of times over a predetermined period to arrive at a plurality of Reid vapor pressures corresponding to a measured fuel pressure decay rate;

compare the fuel pressure decay rate to a plurality of reference fuel pressure decay rates each corresponding to a different fuel leak diameter of the fuel system to determine which one of the reference fuel pressure decay rates the measured fuel pressure decay rate corresponds to; and determine that the fuel system has a fuel leak with a diameter corresponding to the fuel leak diameter of the reference fuel pressure decay rate that the measured fuel pressure decay rate corresponds to.

17. The fuel system of claim 13, wherein the control module is further configured to:

determine the Reid vapor pressure a plurality of times over a predetermined period to arrive at a plurality of Reid vapor pressures corresponding to a measured fuel pressure decay rate;

measure fuel level within a fuel tank of the fuel system over the predetermined period of time with a fuel level sensor;

compare the fuel pressure decay rate and the measured fuel level to a plurality of reference fuel pressure decay rates and fuel levels each corresponding to a different fuel leak diameter of the fuel system to determine which one of the reference fuel pressure decay rates and fuel levels the measured fuel pressure decay rate and measured fuel level correspond to; and determine that the fuel system has a fuel leak with a diameter corresponding to the fuel leak diameter of the reference pressure decay rate and fuel level that the measured fuel pressure decay rate and measured fuel level correspond to.

18. The fuel system of claim 13, wherein the control module is further configured to modify an air-fuel ratio of an engine in receipt of fuel from the fuel system based on the Reid vapor pressure.

19. The fuel system of claim 13, wherein the control module is further configured to determine the Reid vapor pressure with a fuel tank isolation valve of the fuel system closed and a canister purge valve of the fuel system open.

20. The fuel system of claim 19, wherein the fuel tank isolation valve is between the EVAP canister and the fuel tank.

* * * * *